US010941617B2

(12) United States Patent
Benchikh et al.

(10) Patent No.: US 10,941,617 B2
(45) Date of Patent: Mar. 9, 2021

(54) METHOD OF DRILLING A GROUND USING A ROBOTIC ARM

(71) Applicant: SOLETANCHE FREYSSINET, Rueil Malmaison (FR)

(72) Inventors: Laredj Benchikh, Vert Saint Denis (FR); Daniel Perpezat, Rueil Malmaison (FR); Lotfi Beji, Lisse (FR); Sara Cascarino, Rueil Malmaison (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 401 days.

(21) Appl. No.: 15/323,775

(22) PCT Filed: Jul. 8, 2015

(86) PCT No.: PCT/FR2015/051884

§ 371 (c)(1),
(2) Date: Jan. 4, 2017

(87) PCT Pub. No.: WO2016/005701

PCT Pub. Date: Jan. 14, 2016

(65) Prior Publication Data

US 2017/0159361 A1 Jun. 8, 2017

(30) Foreign Application Priority Data

Jul. 9, 2014 (FR) ..... 1456602

(51) Int. Cl.

| | |
|---|---|
| ***E21B 7/02*** | (2006.01) |
| ***E21B 19/20*** | (2006.01) |
| ***E21B 19/24*** | (2006.01) |
| ***E21B 7/04*** | (2006.01) |
| ***E21B 19/08*** | (2006.01) |

(Continued)

(52) U.S. Cl.

CPC ..... *E21B 7/023* (2013.01); *E21B 7/04* (2013.01); *E21B 19/08* (2013.01); *E21B 19/087* (2013.01);

(Continued)

(58) Field of Classification Search

CPC ..... B25J 9/1687; E21B 7/04; B32B 37/12; B21B 19/08; B21B 19/087; B21B 19/15; B21B 19/16; B21B 19/20; B21B 19/24

(Continued)

(56) References Cited

U.S. PATENT DOCUMENTS 3,833,071 A * 9/1974 Koosman ..... E21B 7/00 405/50
4,750,571 A * 6/1988 Geeting ..... E21B 43/10 175/171

(Continued)

FOREIGN PATENT DOCUMENTS

EP 2351903 A2 8/2011
JP 07139662 A 5/1995

(Continued)

*Primary Examiner* — Anna K Kinsaul
*Assistant Examiner* — Veronica Martin
(74) *Attorney, Agent, or Firm* — MH2 Technology Law Group LLP

(57) ABSTRACT

The invention relates to a method of drilling ground along a drilling direction, the method comprising:

providing at least first and second drill tubes (40, 42);

providing an articulated and motorized manipulator arm (12) having a gripper member (30);

using the gripper member (30) to take hold of the first drill tube (40);

moving the gripper member in the drilling direction so as to drive the first drill tube into the ground, the gripper member releasing the first drill tube; then taking hold of the second drill tube and fastening the second drill tube to the first drill tube; and moving the gripper member so as to drive the first and second drill tubes into the ground.

15 Claims, 7 Drawing Sheets

(51) Int. Cl.
*E21B 19/087* (2006.01)
*E21B 19/15* (2006.01)
*E21B 19/16* (2006.01)

(52) U.S. Cl.
CPC ..... *E21B 19/15* (2013.01); *E21B 19/16* (2013.01); *E21B 19/20* (2013.01); *E21B 19/24* (2013.01); *E21B 7/046* (2013.01)

(58) Field of Classification Search
USPC ..... 173/184, 28, 25, 192
See application file for complete search history.

(56) References Cited

U.S. PATENT DOCUMENTS

| | | | | |
|---|---|---|---|---|
| 5,752,789 | A * | 5/1998 | Stepan | B23Q 5/027 408/115 R |
| 6,234,260 | B1 * | 5/2001 | Coast | G01V 1/16 173/148 |
| 6,641,332 | B1 * | 11/2003 | Alvarado | E02D 5/28 175/323 |
| 7,416,367 | B2 * | 8/2008 | St. Onge | E02D 5/74 405/229 |
| 7,832,496 | B2 * | 11/2010 | Nakayabu | B23B 41/02 173/184 |
| 2013/0277118 | A1 | 10/2013 | Koch et al. | |

FOREIGN PATENT DOCUMENTS

| | | | | |
|---|---|---|---|---|
| JP | 2004100260 | A | 4/2004 | |
| WO | 02/16728 | A1 | 2/2002 | |
| WO | 02/103162 | A1 | 12/2002 | |
| WO | WO-2006061459 | A1 * | 6/2006 | E21B 7/20 |
| WO | 2014/011100 | A1 | 1/2014 | |

* cited by examiner

METHOD OF DRILLING A GROUND USING A ROBOTIC ARM

BACKGROUND OF THE DISCLOSURE

The present disclosure relates to the field of geotechnical engineering, and in particular to methods of drilling the ground, in any type of terrain, which drilling may in particular be horizontal, vertical, or inclined.

Traditionally, ground drilling machines have large slides that serve to guide the movement of drill tubes. Such a slide, an example of which is shown in FIG. 12, forms both a guide for moving a drill tube in translation and also a support for the tube, it being emphasized that the drilling member is usually made up of a plurality of drill tubes connected end to end. For this purpose, the slide presents a length that is significantly longer than a unit element of the drill tube element, i.e. generally a length of about five meters.

The use of a slide presents several drawbacks.

Firstly, since the slide forms a guide of size that is greater than each unit drill tube element, it presents very considerable weight. Specifically, the slide needs to withstand not only the weight of a unit drill tube element, but also its own weight, together with the weight of the drill head, and the forces associated with drilling. As a result, the slide is very heavy and particularly bulky.

Because of the large weight and bulk of the slide, the ground drilling machine needs to be provided with a mechanism for moving and steering the slide that is complex, heavy, and bulky.

Finally, the carrier must also be dimensioned so as to be capable of carrying simultaneously the moving and steering mechanism, the slide, and the first tube, which means that it is necessary to use a carrier that is powerful and therefore bulky and expensive.

OBJECT AND SUMMARY OF THE DISCLOSURE

An object of the present disclosure is to propose a method of drilling ground that can be performed more easily and that requires less space.

To this end, the disclosure provides a method of drilling ground along a drilling direction, the method comprising:

- providing at least first and second drill tubes, each having a first end and a second end opposite from the first end, the second end of the second drill tube being suitable for securing to the first end of the first drill tube;
- providing an articulated manipulator arm presenting at least three articulation points, the manipulator arm being motorized and provided with a gripper member, while not being provided with a slide;
- using the gripper member to take hold of the first drill tube via its first end;
- using the manipulator arm to align the first drill tube with the drilling direction;
- actuating the manipulator arm to move the gripper member along the drilling direction so as to drive the first drill tube into the ground;
- after driving the first drill tube into the ground, using the gripper member to release the first drill tube; then
- using the gripper member to take hold of the second drill tube via its first end;
- moving the gripper member so as to bring the second end of the second drill tube into a position facing the first end of the first drill tube;

- fastening the second end of the second drill tube to the first end of the first drill tube; and
- moving the gripper member in the drilling direction in order to drive the second drill tube fastened to the first drill tube into the ground.

In the present disclosure, the term "drill tube" is intended to also cover drill pipes which may be smaller in diameter than drill tubes.

It can thus be understood that actuating the manipulator arm serves in particular to take hold of the first and second drill tubes, to align them with the drilling direction, to secure them to each other in order to form a tubular drilling assembly of great length, and to introduce said assembly into the ground.

Actuating the articulated manipulator arm, which serves to move the gripper member, consists in imparting at least one deformation to the manipulator arm. In other words, the gripper member is moved along the drilling direction by deforming the manipulator arm.

It could also be understood that the alignment step consists in aligning the longitudinal axis of the drill tube with the drilling direction.

The second drill tube may be fastened to the first drill tube by acting on the gripper member, e.g. by moving the gripper member in translation for clamping purposes or by rotating it for screw-fastening purposes.

The second drill tube may be also aligned with the drilling direction prior to being secured to the first drill tube.

The manipulator arm may be an articulated robot presenting a sufficient number of degrees of freedom to enable the gripper member to be positioned and moved in particular along a straight-line path that coincides with the drilling direction, thus, the manipulator arm is actuated by deforming and moving the arm.

By means of the disclosure, drill tubes can be inserted into the ground without requiring the presence of a slide, insofar as it is the manipulator arm that serves to align the drill tube with the drilling direction.

Thrust along the drilling direction may be obtained by moving the gripper member along the drilling direction. More precisely, actuating the manipulator arm by deforming it has the effect of moving the gripper member along the drilling direction, and thus of thrusting the first drill tube along the drilling direction.

To drive the first drill tube into the ground, the gripper member exerts thrust on the first drill tube along the drilling direction.

In the disclosure, the ground for drilling may be horizontal, vertical, or indeed inclined. In particular, the method of the disclosure can be implemented when drilling into a wall that is substantially vertical.

The first and second drill tubes may be stored in at least one storage zone arranged in the proximity of the manipulator arm. It can be understood that the gripper member retrieves the first and second drill tubes in succession from the storage zone. It can be understood that the disclosure enables the drill tubes to be stored in a manner that need not necessarily be well ordered, the manipulator arm being arranged to take hold of a drill tube via one of its ends, regardless of its orientation, and prior to putting the drill tube into alignment.

Without going beyond the ambit of the present disclosure, the method of the disclosure may be repeated so as to insert into the ground a tubular drilling assembly that is made up of a number of drill tubes that is greater than two.

After the drilling operation, the gripper member may also be used for extracting the tubular drilling assembly by decoupling the drill tubes from one another so as to withdraw them in succession from the ground, and finally put them back in the storage zone.

Thus, the drilling method of the disclosure is faster and easier to implement than prior art methods in which additional and specific tooling is generally needed in order to retrieve the drill tubes and place them in the slide.

The first drill tube may be driven into the ground by setting it into rotation while exerting thrust thereon in the drilling direction.

The first drill tube may be driven into the ground by vibrating it while exerting thrust thereon in the drilling direction.

Setting the first drill tube into vibration can be combined with setting it into rotation.

According to some embodiments, there is also provided a retainer member having an axis that is substantially parallel to the drilling direction, the retainer member is placed facing the ground to be drilled, and the first drill tube is driven into the ground after inserting the second end of the first drill tube through the retainer member.

The function of the retainer member is to block movement of the first drill tube axially, e.g. in order to hold the first drill tube in the ground while it is being fastened to the second drill tube.

The retainer member may be fastened to the ground beforehand. In an implementation, the retainer member is fastened to the wall for drilling.

The retainer member may include guide means for facilitating guidance of the first drill tube.

In a variant, the retainer member may be arranged facing the wall for drilling, but without being fastened thereto.

While driving the first drill tube into the ground, the first drill tube may be maintained in alignment with the drilling direction, where necessary, by adjusting the position and/or the orientation of the retainer member.

It can be understood that monitoring the alignment of the first drill tube makes it possible to correct the drilling path. The position and/or the orientation of the gripper member is/are adjusted periodically, for example, in real time, whereby the drilling path is corrected periodically during drilling.

The disclosure also provides an installation for drilling ground, along a drilling direction, by performing the drilling method of the disclosure, which installation comprises:

- at least first and second drill tubes, each having a first end and a second end opposite from the first end, the second end of the second drill tube being suitable for securing with the first end of the first drill tube; and
- an articulated manipulator arm presenting at least three articulation points, the manipulator arm not being provided with a slide, and comprising:
  - a gripper member configured to grip one or the other of the first and second drill tubes via its first end;
  - alignment means for aligning the first drill tube with the drilling direction;
  - drive means for driving the first drill tube into the ground along the drilling direction;
  - fastener means for fastening the second end of the first drill tube to the first end of the first drill tube; and
  - actuator means for actuating the manipulator arm in such a manner as to move the gripper member along the drilling direction so as to drive the second drill tube fastened to the first drill tube into the ground.

As mentioned above, the manipulator arm is deformable and presents a plurality of degrees of freedom enabling the gripper member to be steered and moved, in particular along a straight-line direction. The manipulator arm is thus actuated by deforming and/or moving said arm, which movement may be a movement in rotation.

The drive means for driving one or the other of the first and second drill tubes into the ground are arranged to move the gripper member along the drilling direction, which gripper member is holding the drill tube via its first end. For this purpose, the gripper member exerts thrust on the drill tube along the drilling direction. The manipulator arm may include an arm that exerts thrust on the gripper member, which thrust is directed along the drilling direction.

According to embodiments of the disclosure, the manipulator arm may not have an elongate slide for guiding drill tubes. In other words, the manipulator arm does not have a slide of the kind shown in FIG. 12 of a length that is substantially equal to or longer than the length of the drill tube.

The thrust exerted by the gripper member on the first drill tube may be determined, and for example corrected, while drilling is taking place.

The speed at which the first drill tube penetrates may be determined, and for example corrected, while drilling is taking place.

To do this, the manipulator arm has movement sensors and force sensors suitable for determining the penetration speed of the drill tubes, and also the forces applied to said drill tubes. These values can be compared periodically, for example, in real time, with target values. The operator can then modify the thrust force or the travel speed of the gripper member in order to correct these values. According to some embodiments, the corrections may be performed automatically.

The alignment means serve to align the longitudinal axis of the drill tubes with the drilling direction.

The installation may further comprise measurement means for determining the position and the orientation in three-dimensional space of the gripper member, and the alignment means make use of measurement data supplied by the measurement means.

The alignment means also enable the path of the drill tube to be corrected while drilling is taking place, so as to ensure that the drilling path remains a straight line during drilling.

The measurement means serve periodically, for example, in real time, to determine the position and the orientation of the gripper member, and consequently the position and the orientation of the drill tube held by the gripper member.

Furthermore, and preferably, the manipulator arm is servo-controlled in terms of path, speed, and forces.

Alternatively, the alignment means may include a sensor suitable for following a laser beam defining the drilling direction.

The installation of the disclosure may further comprise a retainer member having an axis that is substantially parallel to the drilling direction, the retainer member being arranged to have one or the other of the first and second drill tubes passed therethrough.

The retainer member may further comprise a controllable blocker device for blocking movement in translation of the first drill tube relative to the ground along the drilling direction.

For example, the blocker device is actuated so as to block the first drill tube in the ground while the gripper member is securing the second drill tube to the first drill tube, e.g. by clamping or by screw-fastening.

The blocker device may also be actuated during a stage of withdrawing drill tubes, in order to hold the first drill tube in place while the gripper member separates the second drill tube from the second drill tube.

According to some embodiments, the retainer member may further comprise a rotary head enabling at least the first drill tube to be set into rotation when said first drill tube is co-operating with the retainer member.

In this embodiment, the gripper member exerts only thrust along the drilling direction on the drill tube, and it is the rotary head of the retainer member that sets it into rotation.

The manipulator arm may further comprise an actuator head enabling at least the first drill tube to be set into rotation and/or into vibration.

In an embodiment, the gripper member includes said actuator head.

In another embodiment, the installation further comprises at least one drill pipe, and the gripper member is also configured to take hold of the drill pipe and to insert it in the first drill tube inserted into the ground.

In a variant, the first drill tube is inserted into the ground initially prior to inserting the drill pipe in the first drill tube. In another variant, the drill pipe is inserted into the first drill tube prior to inserting the assembly into the ground.

Finally, according to some embodiments, the manipulator arm is an articulated robot presenting at least three articulation points.

BRIEF DESCRIPTION OF THE DRAWINGS

The disclosure can be better understood on reading the following description of embodiments of the disclosure given as non-limiting examples and with reference to the accompanying drawings, in which.

DETAILED DESCRIPTION OF THE DISCLOSURE

Figure 1:
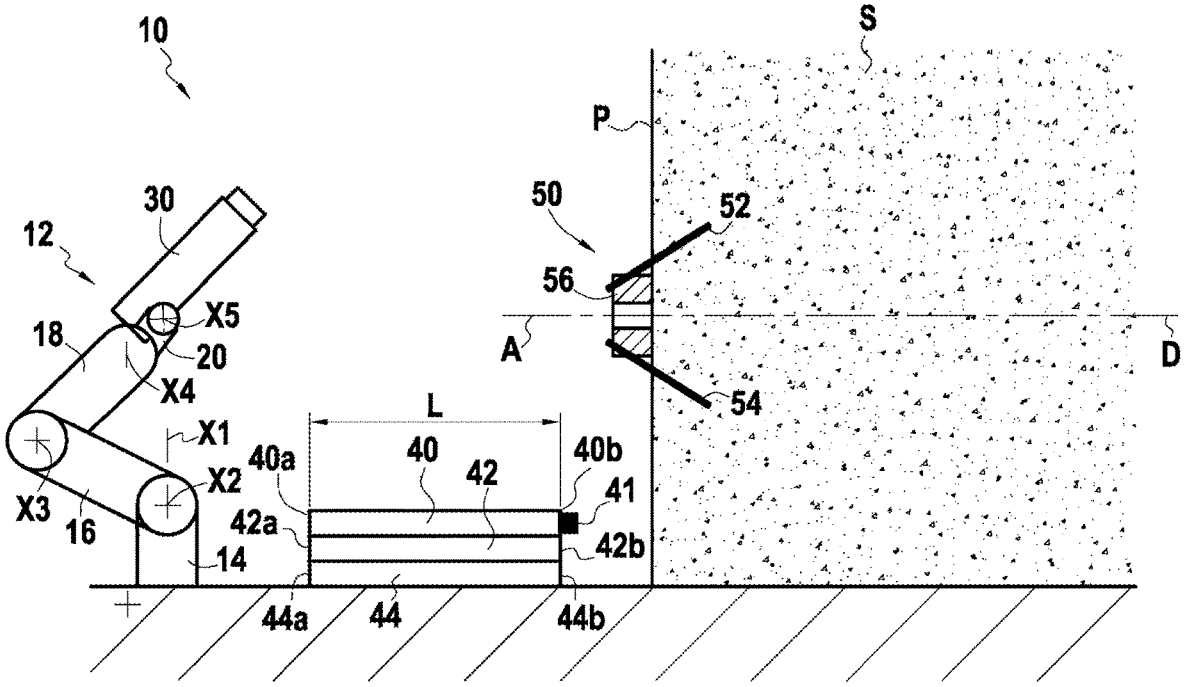
FIG. 1 shows an installation of the disclosure before beginning drilling operations.

FIG. 1 shows an embodiment of an installation 10 for drilling ground S in accordance with the present disclosure. As described in greater detail below, the installation serves in particular to drill boreholes in a vertical wall P along a drilling direction D that is horizontal.

Without going beyond the ambit of the present disclosure, the wall P could have some other configuration, and the drilling direction D could slope relative to the horizontal, or could indeed be vertical.

The installation 10 comprises an articulated and motorized manipulator arm 12 that, in this example, is a robot having a plurality of articulation axes referenced X1, X2, X3, X4, and X5. The manipulator arm presents three articulation points.

More precisely, the manipulator arm has a first portion 14 that can pivot about a vertical pivot axis X1, a second portion 16 that can pivot relative to the first portion 14 about a pivot axis X2, a third portion 18 that can pivot relative to the second portion 16 about a pivot axis X3, and a fourth portion 20 articulated relative to the third portion 18.

Unlike the prior art, the manipulator arm does not have a slide.

The manipulator arm 12 also has a gripper member 30 that is articulated relative to the fourth portion 20. As can be seen, the gripper member is arranged at the end of the manipulator arm. The manipulator arm 12 has actuator means (not shown) that serve to set the various portions into movement relative to one another so as to deform the manipulator arm and thus steer and move the gripper member 30 in three dimensions. This type of manipulator arm is manufactured in particular by the suppliers Kuka and Fanuc. In contrast, the use of such a manipulator arm in the context of drilling ground in accordance with the present disclosure is not described in the prior art.

In this example, the articulations and the various portions are shown diagrammatically. It should be understood that the manipulator arm is configured in particular to enable the movable gripper member to move in a straight line, and in particular along the drilling direction D.

In this example, the installation 10 also has a plurality of drill tubes, specifically in this example a first drill tube 40 of length L, a second drill tube 42, and a third drill tube 44. Each of the first, second, and third drill tubes has a first end 40*a*, 42*a*, 44*a*, and a second end 40*b*, 42*b*, 44*b* opposite from its first end. Each of these drill tubes presents a longitudinal axis. These tubes are designed to be secured end to end to one another so as to form a tubular drilling assembly of great length. Naturally, without going beyond the ambit of the present disclosure, these tubes could be in the form of drill pipes.

Figure 12:
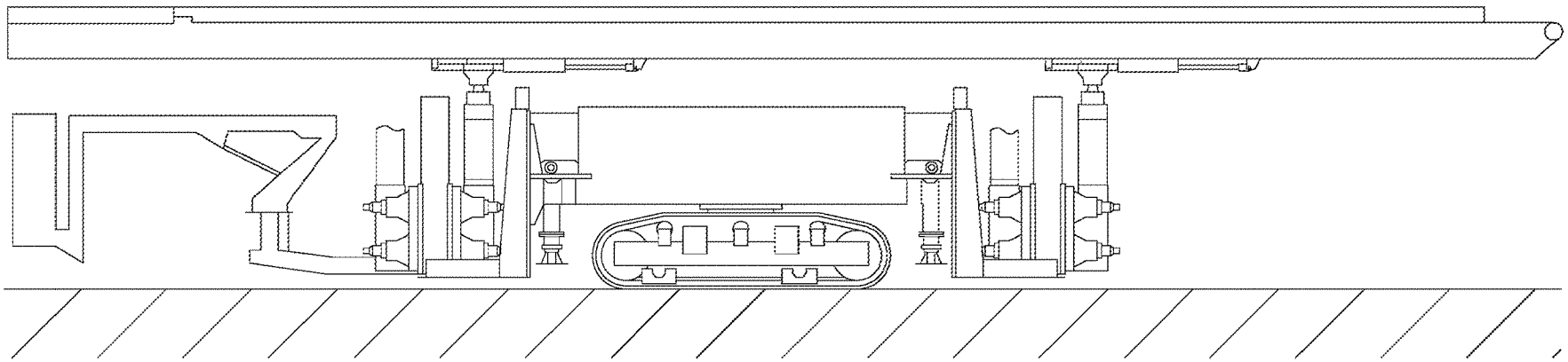
FIG.12 PRIOR ART
FIG. 12 shows an example of a prior art drilling installation.

Furthermore, the manipulator arm does not have an elongate slide for guiding drill tubes, as is shown in FIG. 12 illustrating a prior art installation.

As can be seen in FIG. 1, the second end 40*b* of the first drill tube 40 carries a drill tool 41, in this example a drillbit.

In addition, the second end 42*b* of the second drill tube 42 can be secured to the first end 40*a* of the first drill tube 40. In this example, the first and second drill tubes are secured to each other by screw-fastening.

The gripper member 30 is configured to take hold of one or another of the first, second, and third drill tubes via its first end.

Figure 2:
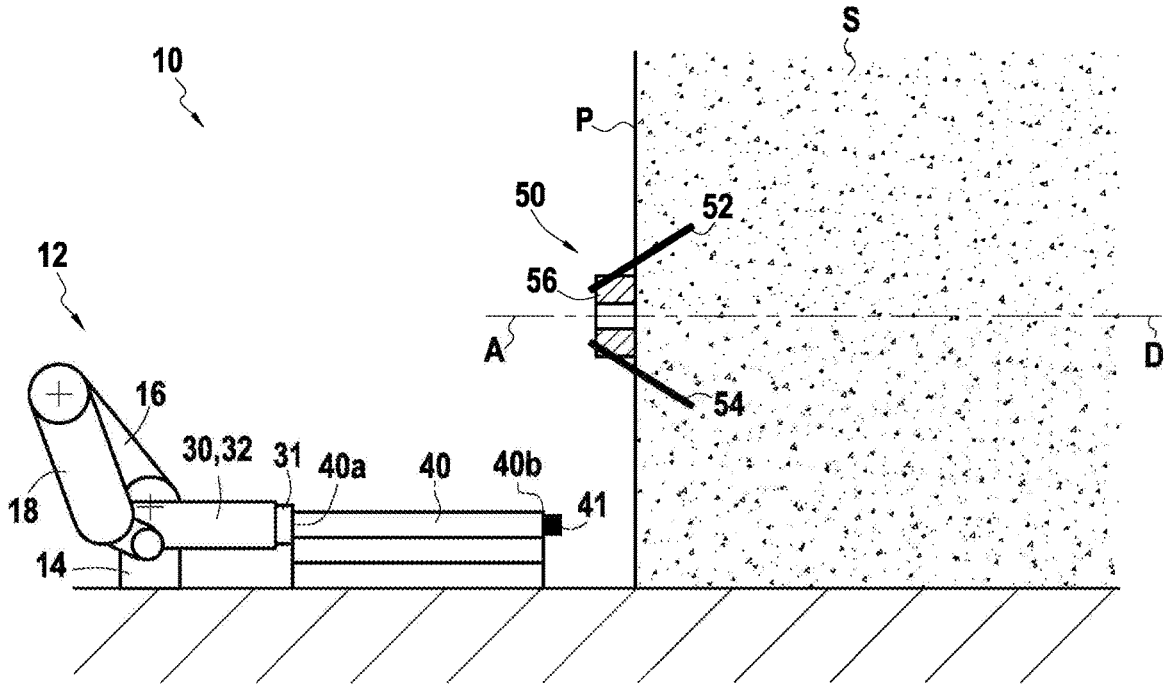
FIG. 2 shows the step of the gripper member taking hold of the first drill tube.

In the example of FIG. 2, the gripper member 30 is taking hold of the first drill tube 40 via its first end 40*a*. To do this, the gripper member 30 includes clamp-forming means 31 that clamp onto the first end 40*a* of the first tube 40. The first drill tube 40 thus constitutes an extension of the gripper member 30.

It is specified that the gripper member 30 also has an actuator head 32 that, in this example, serves to impart both rotation and vibration to the first drill tube 40.

In this example, the installation 10 also has a retainer member 50 of axis A that is substantially parallel to the drilling direction D.

In the example of FIG. 1, the retainer member 50 is securely fastened to the wall P by fastener means 52, 54.

The retainer member 50 is in the form of a sleeve suitable for having one or another of the first, second, and third drill tubes passed therethrough. Still in the example of FIG. 1, the retainer member 50 also has a controllable blocker device 56, which is described in greater detail below, for the purpose of blocking the first drill tube against moving in translation relative to the ground along the drilling direction D.

The manipulator arm 12 also has drive means 60 for driving the first drill tube 40 into the ground S along the drilling direction D. In this example, the means for driving the first drill tube comprise the various portions 14, 16, 18, and 20 making up the manipulator arm and the actuator means enabling the various portions to be moved relative to one another so as to exert straight-line thrust on the gripper member, this thrust being directed along the drilling direction D.

Figure 3:
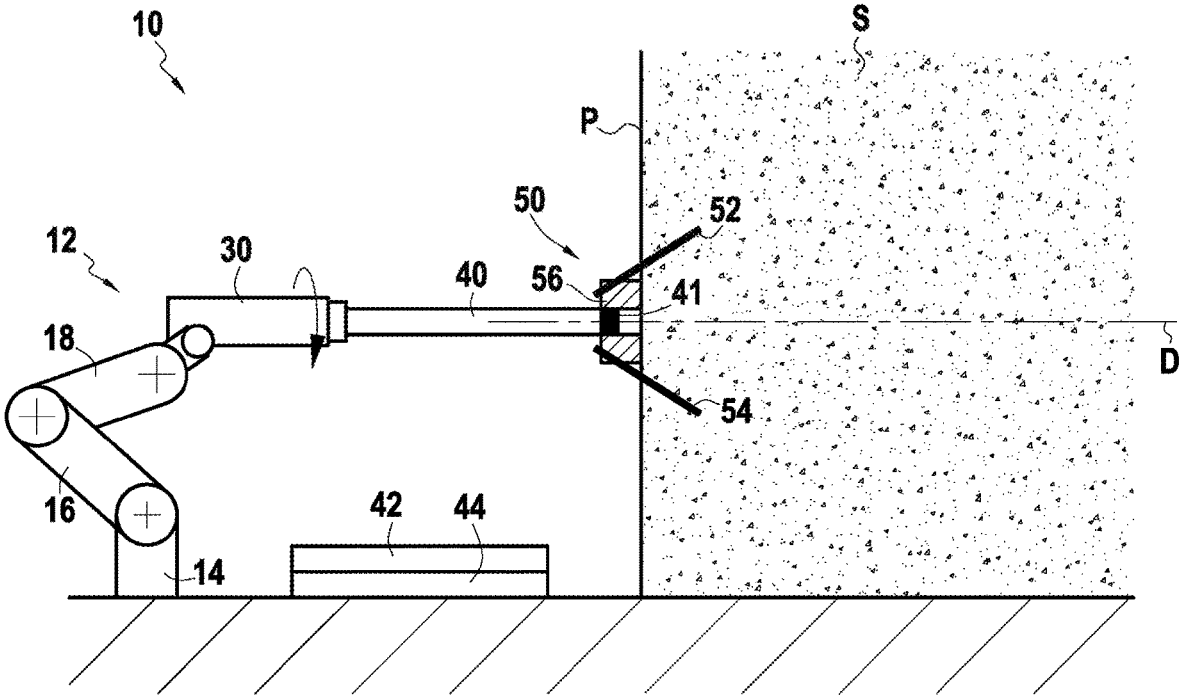
FIG. 3 shows the step of aligning the first drill tube with the drilling direction.
Figure 4:
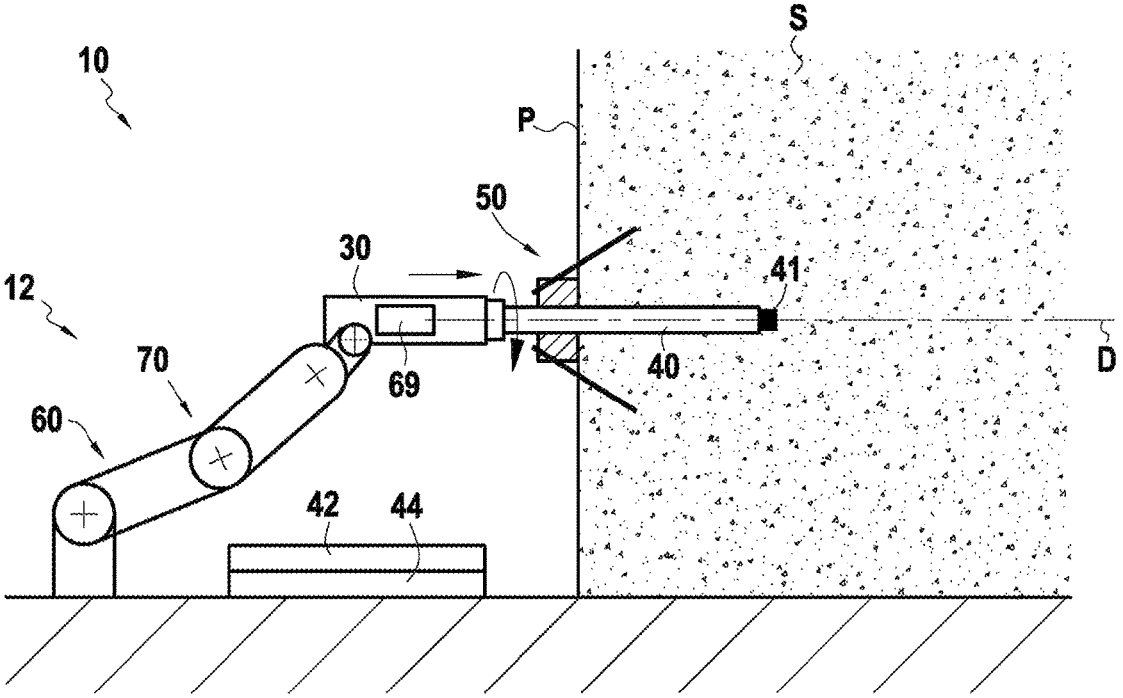
FIG. 4 shows the step of driving the first drill tube into the ground.
Figure 5:
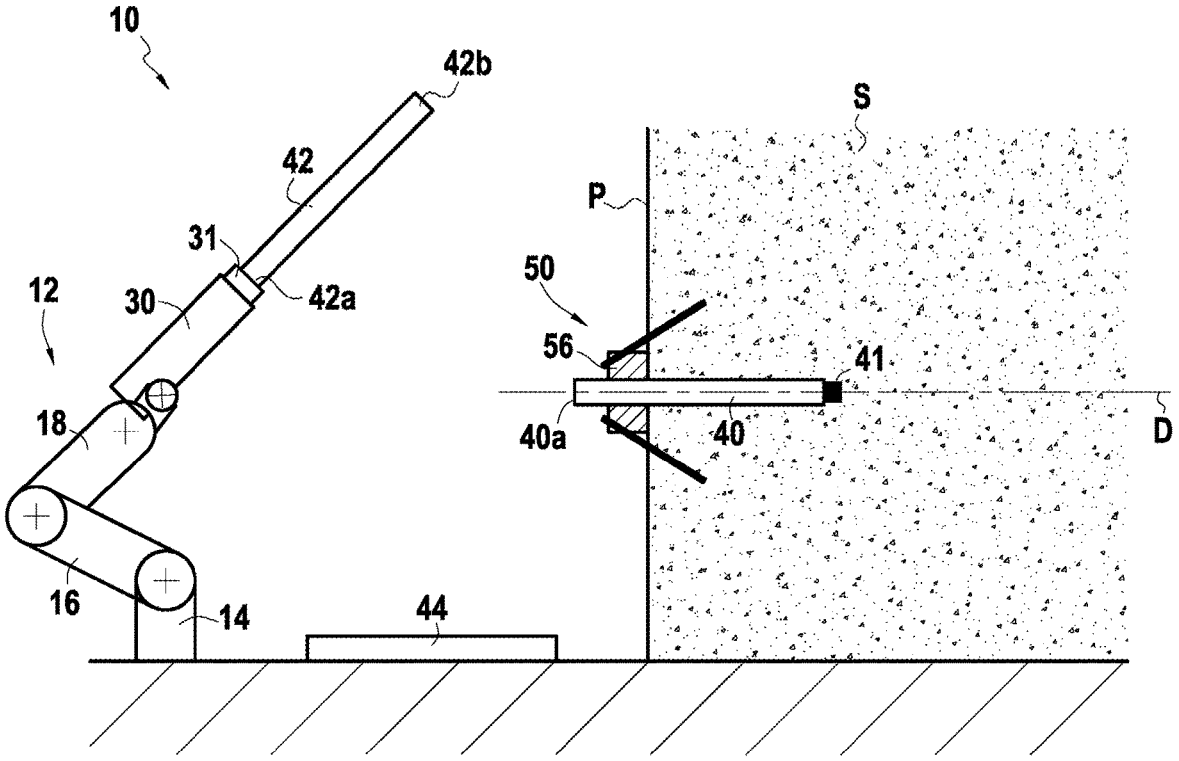
FIG. 5 shows the step of moving the second drill tube after it has been taken hold of by the gripper member.
Figure 6:
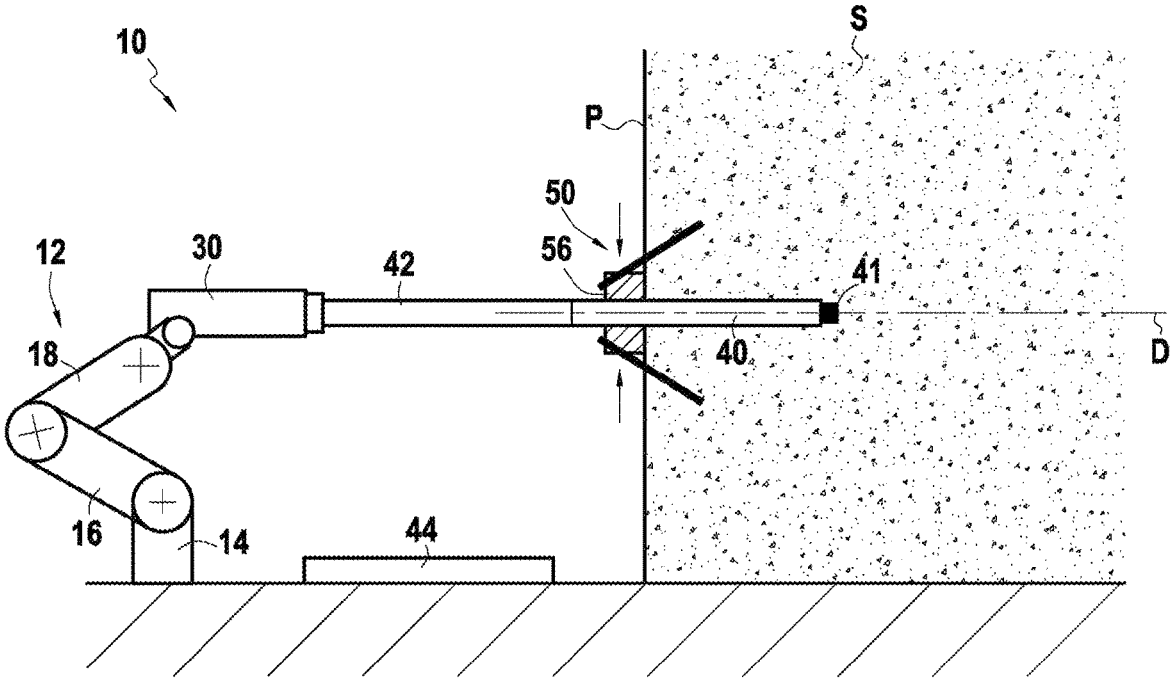
FIG. 6 shows the step of fastening the second drill tube to the first drill tube.

This step of driving the first drill tube 40 into the ground S is shown in FIGS. 3 and 4.

The manipulator arm also has alignment means 70 for aligning the first drill tube 40 with the drilling direction D, the alignment means in this example comprising the various portions making up the manipulator arm and the actuator means, thereby enabling the longitudinal axis of the first drill tube to be put into alignment with the drilling direction D.

It is specified that the installation further includes measurement means 69 (shown in FIG. 4) for determining the position and the orientation in three dimensions of the gripper member 30, these measurement means in this example comprising one or more gyros, or any other sensor for sensing position and orientation in three dimensions.

The alignment means make use of measurement data supplied by the measurement means 69 in order to put the longitudinal axis of the first drill tube 40 into alignment with the drilling direction D.

As shown in FIG. 3, after taking hold of the first drill tube 40, the gripper member 30 is moved so that the drill tool 41 is engaged in the retainer member 50. The manipulator arm is then actuated so as to exert straight-line thrust on the gripper member 30 acting in the drilling direction D so as to drive the first drill tube into the ground S.

While exerting thrust on the first drill tube 40 via the gripper member 30, the actuator head 32 is actuated in such a manner as to set the first drill tube 40 into rotation.

In this example, the actuator head also includes a vibration generator for vibrating the first drill tube 40.

In other words, the first drill tube is driven into the ground by setting it into rotation, while also causing it to vibrate and thrusting it along the drilling direction D, as shown in FIG. 4.

After the first drill tube 40 has been driven into the ground S, the blocker device 56 is actuated in order to prevent any axial movement of the first drill tube 40. The gripper member 30 releases the first end 40*a* of the first drill tube 40, and retrieves the second drill tube 42, taking hold of it via its first end 42*a*.

The manipulator arm is then actuated so as to put the longitudinal axis of the second drill tube 42 into alignment with the drilling direction D.

The gripper member 30 is then moved so as to bring the second end 42*b* of the second tube 42 into a position facing the first end 40*a* of the first drill tube 40. The second drill tube 42 is then secured to the first drill tube 40 by screw-fastening, by using the actuator head 32 to turn the drill tube 42 so as to screw the second end of the second drill tube to the end part of the first drill tube 40 that is held blocked in the ground by the blocker device 56.

It can thus be understood that the manipulator arm 12 also has fastener means 80 for fastening the second end 42*b* of the second tube 42 to the first end 40*a* of the first drill tube 40, and in this example said means comprise in particular the actuator head of the gripper member 30.

After the second drill tube 42 has been secured to the first drill tube 40, and more precisely after the second end of the second drill tube has been fastened to the first end of the first drill tube, the blocker device 56 is released so as to allow the first drill tube 40 to move freely in translation along the drilling direction D. The gripper member 30 is then moved along the drilling direction D so as to drive the second drill tube fastened to the first drill tube into the ground. This movement is thus a movement in translation performed along the drilling direction D.

Figure 7:
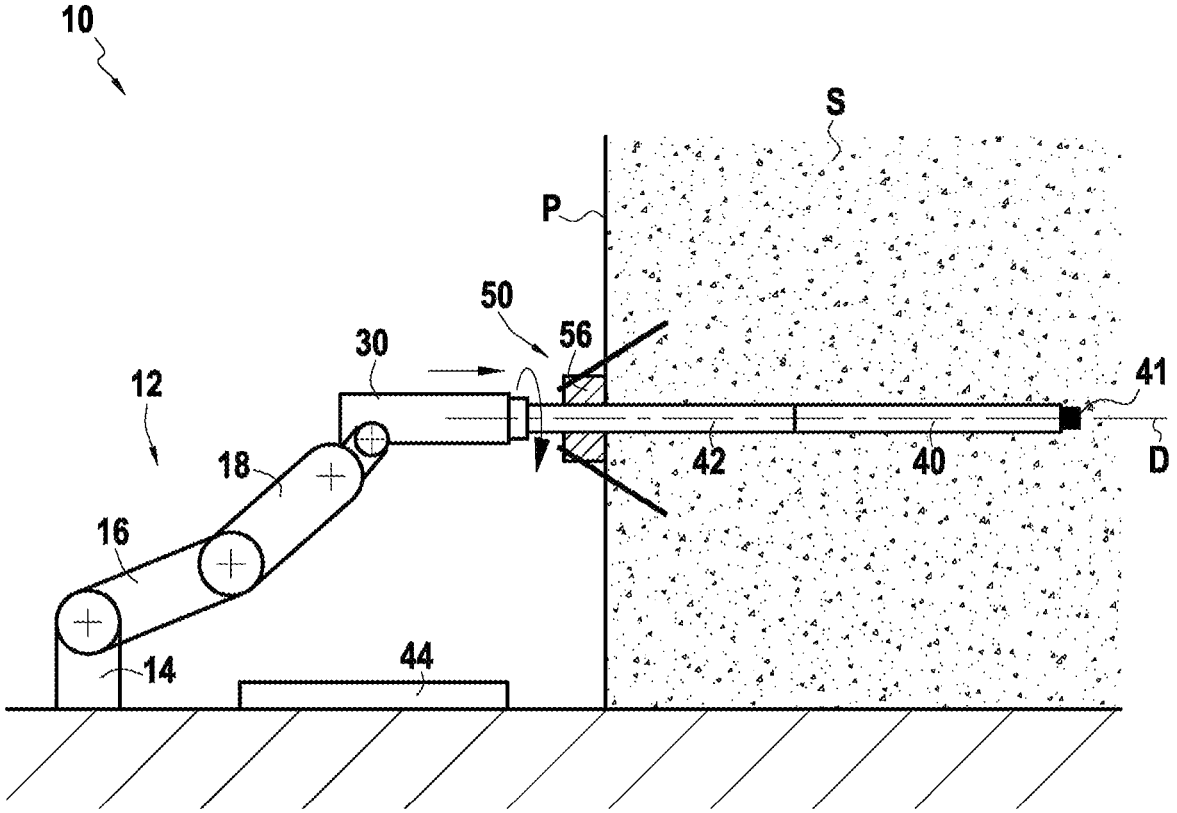
FIG. 7 shows the step of driving the second drill tube, while fastened to the first drill tube, into the ground.

Likewise, the second drill tube 42 is set into rotation while moving the gripper member 30 so as to drive the drill tube 41 in rotation. The second drill tube is also caused to vibrate. This step is shown in FIG. 7.

Thus, the implementation of the drilling method of the disclosure as shown in FIGS. 1 to 7 comprises:

- providing first and second drill tubes 40, 42, each having a first end 40*a*, 42*a* and a second end 40*b*, 42*b* opposite from the first end, the second end of the second drill tube being suitable for securing to the first end of the first drill tube;
- providing a manipulator arm 12 having a movable gripper member 30;
- using the gripper member 30 to take hold of the first drill tube 40 via its first end 40*a;*
- using the manipulator arm 12 to align the first drill tube with the drilling direction D, and more specifically by adjusting the position of the gripper member 30;
- moving the gripper member 30 in the drilling direction so as to drive the first drill tube 40 into the ground while putting the first drill tube into rotation;
- after driving the first drill tube 40 into the ground, using the gripper member 30 to release the first drill tube; then
- using the gripper member 30 to take hold of the second drill tube 42 via its first end 42*a;*
- moving the gripper member 30 so as to bring the second end of the second drill tube into a position facing the first end of the first drill tube;
- screw-fastening the second end 42*b* of the second drill tube 42 to the first end 40*a* of the first drill tube 40 by causing the actuator head 32 to turn; and
- moving the gripper member 30 in the drilling direction D in order to drive the second drill tube fastened to the first drill tube into the ground.

Furthermore, while driving the first drill tube 40 into the ground, and likewise while driving the second drill tube into the ground, the first and second drill tubes are kept in alignment with the drilling direction by periodically comparing the real drilling path with the desired drilling direction D and, where necessary, by adjusting the position and the orientation in three-dimensional space of the gripper member 30, in order to correct the path.

Figure 8:
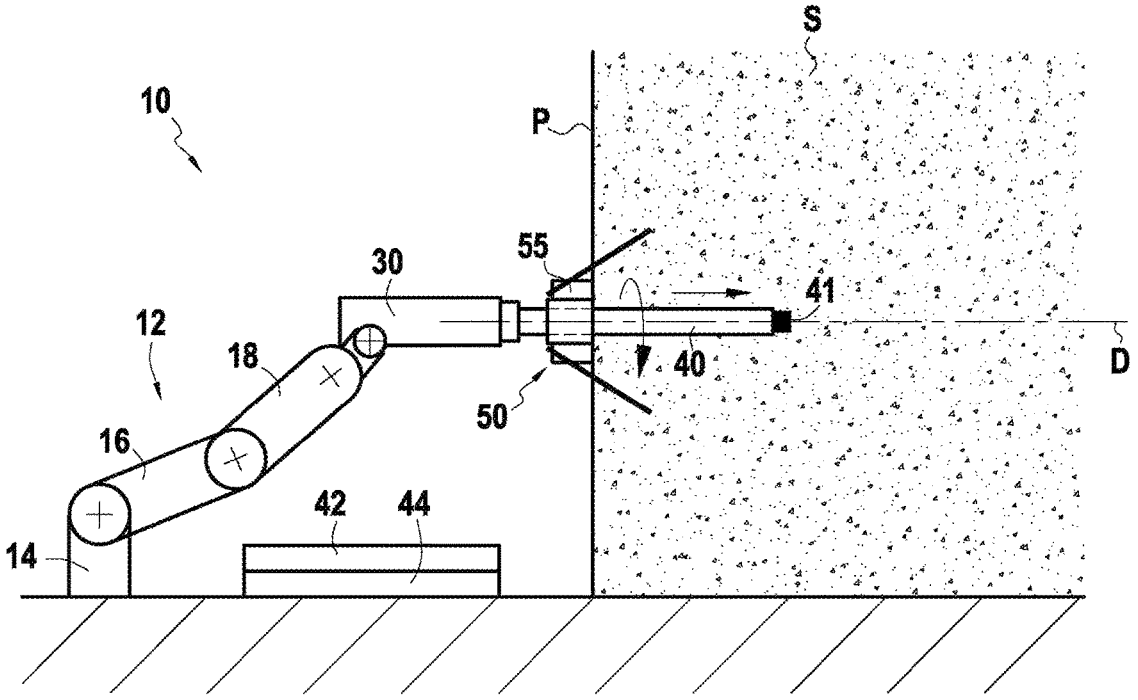
FIG. 8 shows a variant embodiment in which the installation includes a retainer member having a rotary actuator head.

FIG. 8 shows an embodiment in which the retainer member 50 also has a rotary head 55 that enables the first drill tube 40 to be set into rotation when the first drill tube 40 is co-operating with the retainer member 50. In other words, in the embodiment of FIG. 13, the rotary head is situated in the retainer member 50 and not in the gripper member 30.

It can thus be understood that the rotary head 55 is arranged to set the first drill tube 40 into rotation while the gripper member 30 is moving so as to drive the first guide tube 40 into the ground.

Figure 9:
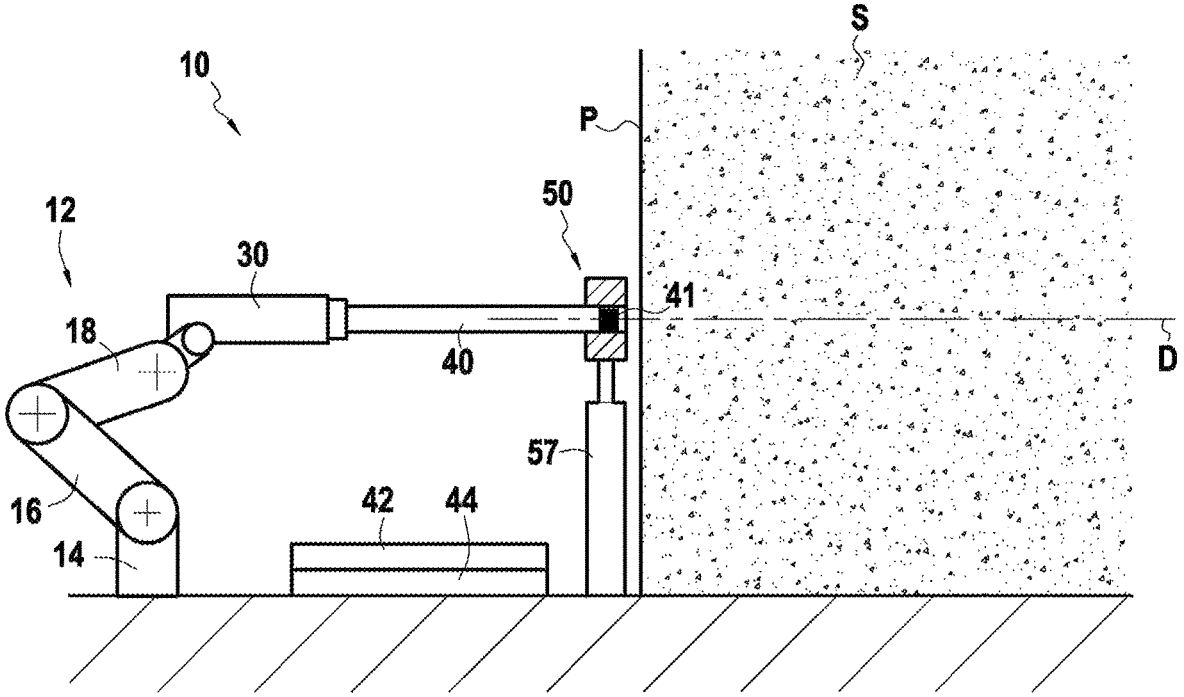
FIG. 9 shows another variant in which the retainer member is placed in front of the wall for drilling.

In the variant of FIG. 9, the retainer member 50 is arranged facing the wall P for drilling, but is not fastened thereto. The retainer member 50 stands on the ground via a stand 57.

Figure 10:
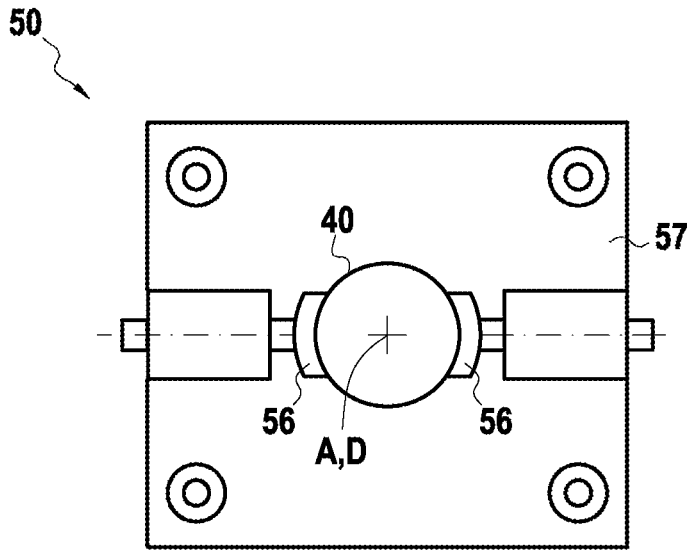
FIG. 10 shows an embodiment of the retainer member used when the drilling direction is horizontal.

In FIG. 10, there can be seen the retainer member 50 when drilling is horizontal. In this example, the retainer member 50 has hydraulic jaws 56 mounted on a plate 57.

Figure 11:
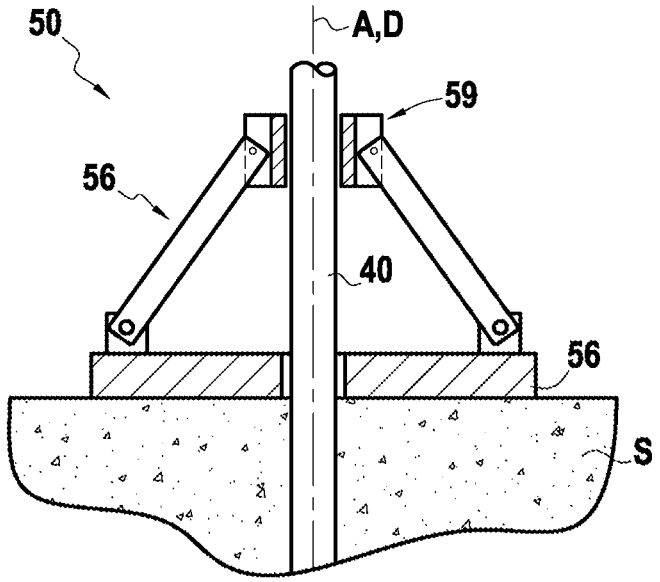
FIG. 11 shows an embodiment of the retainer member used when the drilling direction is vertical.

In FIG. 11, there can be seen a variant of the retainer member 50 used when the drilling is vertical. In this example, the retainer member 50 comprises a collapsible guillotine system 59 with the first guide tube 40 being held by friction.

The invention claimed is:

1. A method of drilling a ground along a drilling direction, the method comprising:

providing at least first and second drill tubes, each having a first end and a second end opposite from the first end, the second end of the second drill tube being suitable for securing to the first end of the first drill tube;

providing a robotic arm, which is an articulated and motorized arm presenting at least three articulation points and provided with a gripper member;

using the gripper member to take hold of the first drill tube via its first end;

using the manipulator arm to align the first drill tube with the drilling direction;

actuating the manipulator arm to move the gripper member along the drilling direction so as to drive the first drill tube into the ground without using a slide;

after driving the first drill tube into the ground, using the gripper member to release the first drill tube; then using the gripper member to take hold of the second drill tube via its first end;

moving the gripper member so as to bring the second end of the second drill tube into a position facing the first end of the first drill tube;

fastening the second end of the second drill tube to the first end of the first drill tube; and moving the gripper member in the drilling direction in order to drive the second drill tube fastened to the first drill tube into the ground;

using the gripper member for extracting the tubular drilling assembly by decoupling the first and second drill tubes from one another so as to withdraw them in succession from the ground.

2. The drilling method according to claim 1, wherein the first drill tube is driven into the ground by setting it into rotation while exerting thrust thereon in the drilling direction.

3. The drilling method according to claim 1, wherein the first drill tube is driven into the ground by vibrating it while exerting thrust thereon in the drilling direction.

4. The drilling method according to claim 1, further providing a retainer member having a guide axis substantially parallel to the drilling direction, the retainer member being placed facing the ground to be drilled, and wherein the first drill tube is driven into the ground after inserting the second end of the first drill tube through the retainer member.

5. The drilling method according to claim 4, wherein the retainer member is fastened to the ground before the first drill tube is inserted into the ground.

6. The drilling method according to claim 4, wherein, while driving the first drill tube into the ground, the first drill tube is maintained in alignment with the drilling direction, where necessary, by adjusting a position and/or an orientation of the retainer member.

7. An installation for drilling a ground along a drilling direction, comprising:

at least first and second drill tubes, each having a first end and a second end opposite from the first end, the second end of the second drill tube being suitable for securing with the first end of the first drill tube;

an articulated and motorized manipulator arm, the manipulator arm presenting at least three articulation points, and comprising:

a gripper member configured to grip one or the other of the first and second drill tubes via its first end;

an alignment device for aligning the first drill tube with the drilling direction;

an actuator device for actuating the manipulator arm to move the gripper member along the drilling direction so as to drive the first drill tube into the ground along the drilling direction without using a slide;

a fastener device for fastening the second end of the second drill tube to the first end of the first drill tube; and a drive device for moving the gripper member along the drilling direction so as to drive the second drill tube fastened to the first drill tube into the ground; and a retainer member having an axis substantially parallel to the drilling direction, the retainer member being positioned outside of the ground and configured to have one or the other of the first and second drill tubes passed therethrough along said axis, the retainer member further comprising a controllable blocker device for blocking movement in translation of the first drill tube relative to the ground along said axis.

8. The drilling installation according to claim 7, wherein the retainer member further comprises a rotary actuator head for driving in rotation at least the first drill tube when said first drill tube is co-operating with the retainer member.

9. The drilling installation according to claim 7, wherein the manipulator arm further comprises an actuator head enabling at least the first drill tube to be set into rotation and/or into vibration.

10. The drilling installation according to claim 7, further comprising a measurement device for determining a position and an orientation in three-dimensional space of the gripper member, and wherein the alignment device make use of measurement data supplied by the measurement device.

11. The drilling installation according to claim 7, further comprising at least one drillpipe, and wherein the gripper member is also configured to take hold of the drillpipe and to insert the drillpipe in the first drill tube inserted into the ground.

12. The drilling method according to claim 1, further comprising blocking the first drilling tube in the ground after driving the first drill tube into the ground and before releasing the first drill tube.

13. A method of drilling a ground along a drilling direction, the method comprising:

providing at least first and second drill tubes, each having a first end and a second end opposite from the first end, the second end of the second drill tube being suitable for securing to the first end of the first drill tube;

providing a robotic arm, which is an articulated and motorized arm presenting at least three articulation points and provided with a gripper member;

gripping the first end of the first drill tube with the gripper member;

using the manipulator arm to align the first drill tube with the drilling direction;

moving the gripper member along the drilling direction so as to drive the first drill tube into the ground without using a slide;

after the gripper member has driven the first drill tube into the ground, releasing the gripper member from the first end of the first drill tube; then gripping the first end of the second drill tube with the gripper member;

moving the gripper member so as to bring the second end of the second drill tube into a position facing the first end of the first drill tube;

fastening the second end of the second drill tube to the first end of the first drill tube; and moving the gripper member in the drilling direction in order to drive the second drill tube fastened to the first drill tube into the ground, and using a controllable blocking device positioned outside of the ground for blocking the first drilling tube in the ground after driving the first drill tube into the ground and before releasing the first drill tube from the gripper member.

14. An installation for drilling a ground along a drilling direction, comprising:

at least first and second drill tubes, each having a first end and a second end opposite from the first end, the second end of the second drill tube being suitable for securing with the first end of the first drill tube;

a robotic arm, being articulated and motorized, the robotic arm presenting at least three articulation points, and comprising:

a gripper member configured to grip one or the other of the first and second drill tubes via its first end; an alignment device for aligning the first drill tube with the drilling direction;

an actuator device for actuating the manipulator arm to move the gripper member along the drilling direction so as to drive the first drill tube into the ground along the drilling direction;

a fastener device for fastening the second end of the second drill tube to the first end of the first drill tube by clamping or by screw-fastening;

a drive device for moving the gripper member along the drilling direction so as to drive the second drill tube fastened to the first drill tube into the ground; and a retainer member having an axis substantially parallel to the drilling direction, the retainer member being positioned outside of the ground and configured to have one or the other of the first and second drill tubes passed therethrough along said axis, the retainer member further comprising a controllable blocker device for blocking movement in translation of the first drill tube relative to the ground along said axis.

15. An installation for drilling a ground along a drilling direction, comprising:

at least first and second drill tubes, each having a first end and a second end opposite from the first end, the second end of the second drill tube being suitable for securing with the first end of the first drill tube;

a robotic arm, being articulated and motorized, the robotic arm presenting at least three articulation points, and comprising:

a gripper member configured to grip one or the other of the first and second drill tubes via its first end;

an alignment device for aligning the first drill tube with the drilling direction;

an actuator device for actuating the manipulator arm to move the gripper member along the drilling direction so as to drive the first drill tube into the ground along the drilling direction;

a fastener device for fastening the second end of the second drill tube to the first end of the first drill tube;

a drive device for moving the gripper member along the drilling direction so as to drive the second drill tube fastened to the first drill tube into the ground, wherein the installation further comprises a measurement device for determining during the drilling a position and an orientation in three-dimensional space of the gripper member, and wherein the alignment device makes use of measurement data supplied by the measurement device for correcting the drilling path; and a retainer member having an axis substantially parallel to the drilling direction, the retainer member being positioned outside of the ground and configured to have one or the other of the first and second drill tubes passed therethrough along said axis, the retainer member further comprising a controllable blocker device for blocking movement in translation of the first drill tube relative to the ground along said axis.

* * * * *